US009744437B2

(12) United States Patent
Hsu

(10) Patent No.: US 9,744,437 B2
(45) Date of Patent: Aug. 29, 2017

(54) AUTOMATED CARD SHUFFLING AND DEALING DEVICE

(71) Applicant: Tien-Shu Hsu, Taichung (TW)

(72) Inventor: Tien-Shu Hsu, Taichung (TW)

( * ) Notice: Subject to any disclaimer, the term of this patent is extended or adjusted under 35 U.S.C. 154(b) by 0 days.

(21) Appl. No.: 15/258,305

(22) Filed: Sep. 7, 2016

(65) Prior Publication Data

US 2017/0182401 A1 Jun. 29, 2017

(30) Foreign Application Priority Data

Dec. 29, 2015 (TW) ..... 104144196 A

(51) Int. Cl.
*A63F 1/14* (2006.01)
*A63F 1/12* (2006.01)

(52) U.S. Cl.
CPC . *A63F 1/14* (2013.01); *A63F 1/12* (2013.01)

(58) Field of Classification Search
CPC ..... A63F 1/14; A63F 1/12
See application file for complete search history.

(56) References Cited

U.S. PATENT DOCUMENTS 8,070,160 B2 * 12/2011 Mali ..... A63F 1/12 273/149 P
2007/0090595 A1 * 4/2007 Csikos ..... A63F 1/06 273/149 R
2013/0106054 A1 * 5/2013 Tseng ..... A63F 1/12 273/149 R
2016/0361623 A1 * 12/2016 Huang ..... A63F 1/14

FOREIGN PATENT DOCUMENTS

CN 101125250 B 5/2010
CN 102580306 B 4/2015

* cited by examiner

*Primary Examiner* — Michael Dennis
(74) *Attorney, Agent, or Firm* — Muncy, Geissler, Olds & Lowe, P.C.

(57) ABSTRACT

An automated playing card, shuffling and dealing device in turn shuffles and in turn deals playing cards of two playing card sets, includes two card slot assemblies each disposed with a shuffled card box and a dealt card box. A control unit controls a dealing element to align with the playing card set in the shuffled card box of the card slot assembly at a card drawing position, sequentially draw the cards in the playing card set, and move the uncovered cards to the corresponding dealt card box. Meanwhile, the control unit controls a shuffling machine to align with the playing card set in the dealt card box of the card slot assembly at a card shuffling position. After the dealing process is complete, the control unit exchanges the positions of two card slot assemblies. Accordingly, shuffling and dealing in turn are completed in an uninterrupted and automated manner.

14 Claims, 9 Drawing Sheets

AUTOMATED CARD SHUFFLING AND DEALING DEVICE

FIELD OF THE INVENTION

The present invention relates to a card game, and particularly to playing card shuffling and dealing device.

BACKGROUND OF THE INVENTION

There are numerous playing card games that satisfy people's personal preferences and choices from the young to the elderly. Thus, playing cards are one mainstream of table games, and are also commonly seen in all gaming facilities.

Before a card game begins, the cards are first shuffled to thoroughly to mix the cards, so as to provide unpredictable upcoming cards and prevent issues of man cheating. Most conventional card shuffling processes are performed manually, and the cards are then manually dealt by a card dealer. However, manual card shuffling is costly and is prone to risks of man cheating, and manual card dealing similarly suffers from issues of manpower consuming, slow shuffling speed and also risks of man cheating. Thus, to reduce the manpower used and to eliminate the possibility of cheating, for example, the China Patent Publication No. CN101125250B discloses an automatic card dealing method. The automatic card dealing method of the above disclosure deals cards using a mechanical arm, and identifies the cards using a detector. For another example, the China Patent Publication No. CN102580306B discloses a device for dealing and displaying cards. The device for dealing and displaying cards of the this disclosure includes a card dealing unit, an identification unit and a shuffling machine, so as to achieve zero human contact with the cards and to completely eliminate the risks of man cheating.

Although the above device for dealing and displaying cards eliminates the issue of man cheating, once the cards are dealt, the cards can only be dealt again after the cards are shuffled using the shuffling machine. Such mechanical shuffling process may take a considerable amount of time, in a way that, repeated after a certain period, players participating the card game are required to wait for the shuffling machine to complete the shuffling process, hence causing time waste of the players.

SUMMARY OF THE INVENTION

Therefore, it is a primary object of the present invention to disclose an automated card shuffling and dealing device, which in turn shuffles and in turn deals two playing card sets in a game. The automated card shuffling and dealing device includes a dealing tabletop, a shuffling machine, a dealing element sequentially dealing and uncovering cards according to a rule of the game, a playing card replacement determining element sending a replacement signal according to a predetermined rule, and a control unit. The dealing tabletop includes two card slot assemblies for correspondingly placing the two playing card sets and adapted to move and exchange positions, and a card slot assembly moving mechanism for moving and exchanging the positions of the two card slot assemblies. The two card slot assemblies are each disposed with a shuffled card box and a dealt card box, and are respectively located at a card drawing position and a card shuffling position. The shuffling machine includes a to-be-shuffled slot for accommodating the playing card set to be shuffled and a shuffled slot. The playing card set to be shuffled, after having been shuffled, is stacked in the shuffled slot. Further, the shuffling machine moves the playing card set in the dealt card box to the to-be-shuffled slot, and moves the shuffled playing card set in the shuffled slot to the corresponding shuffled card box.

The control unit first controls the dealing element to align with the playing card set in the shuffled card box of the card slot assembly at the drawing position, sequentially draw and deal the cards in the playing card set, and move the uncovered cards to the corresponding dealt card box. Meanwhile, the control unit controls the shuffling machine to align with and shuffle the playing card set in the dealt card box of the card slot assembly at the card shuffling position. Further, during the dealing process, the playing card replacement determining unit continuously monitors whether the dealing process satisfies the predetermined rule, and sends the replacement signal when the predetermined rule is satisfied to inform the control unit, so as to cause the control unit to control the dealing element to stop dealing and move the remaining cards in the playing card set to the corresponding dealt card box. Next, the control unit controls the card slot assembly moving mechanism to exchange the positions of the two card slot assemblies to have the shuffled card box and the dealt card box of the two card slot assemblies to exchange positions. After the positions are exchange, the control unit then controls the shuffling machine and the dealing element to respectively shuffle and deal the cards to complete one cycle.

Accordingly, through the control of the control unit, between the playing card sets on the two card slot assemblies, while one of the playing card sets is being dealt using the dealing element, the other playing card set may be shuffled using the shuffling machine. After the playing card set used for dealing is completely dealt, the other playing card set may be promptly used through the method of exchanging positions to continue the dealing process, and the playing card set having been used for dealing may be shuffled at the same time using the shuffling machine, hence forming an automated card shuffling and dealing device with a cyclic application approach. Thus, the present invention provides an advantage of needing no waiting time, and cards may be continually dealt to satisfy the needs of players for uninterrupted game playing.

DETAILED DESCRIPTION OF THE PREFERRED EMBODIMENTS

Figure 1:
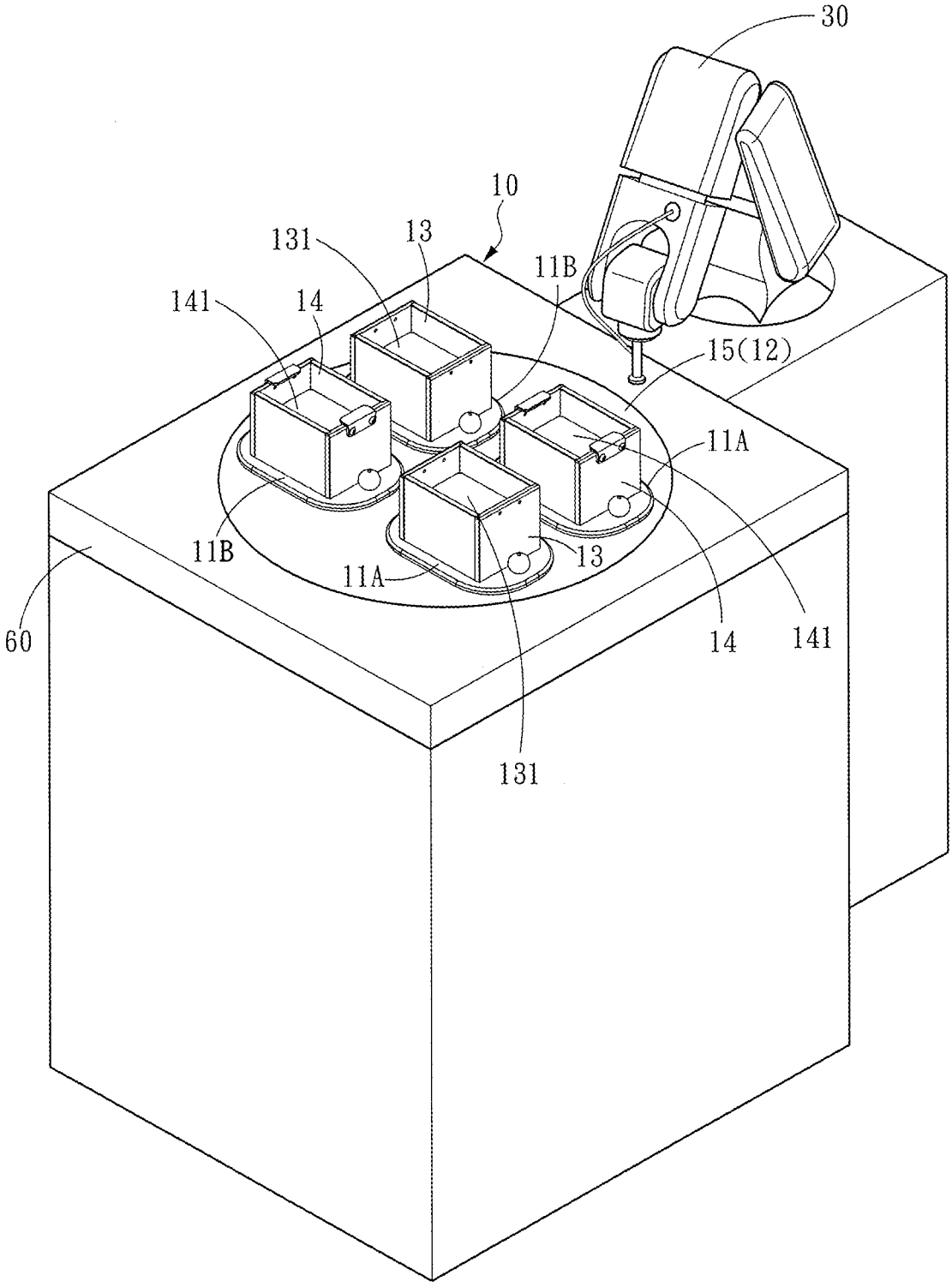
FIG. 1 is a perspective structural diagram of the present invention.
Figure 2:
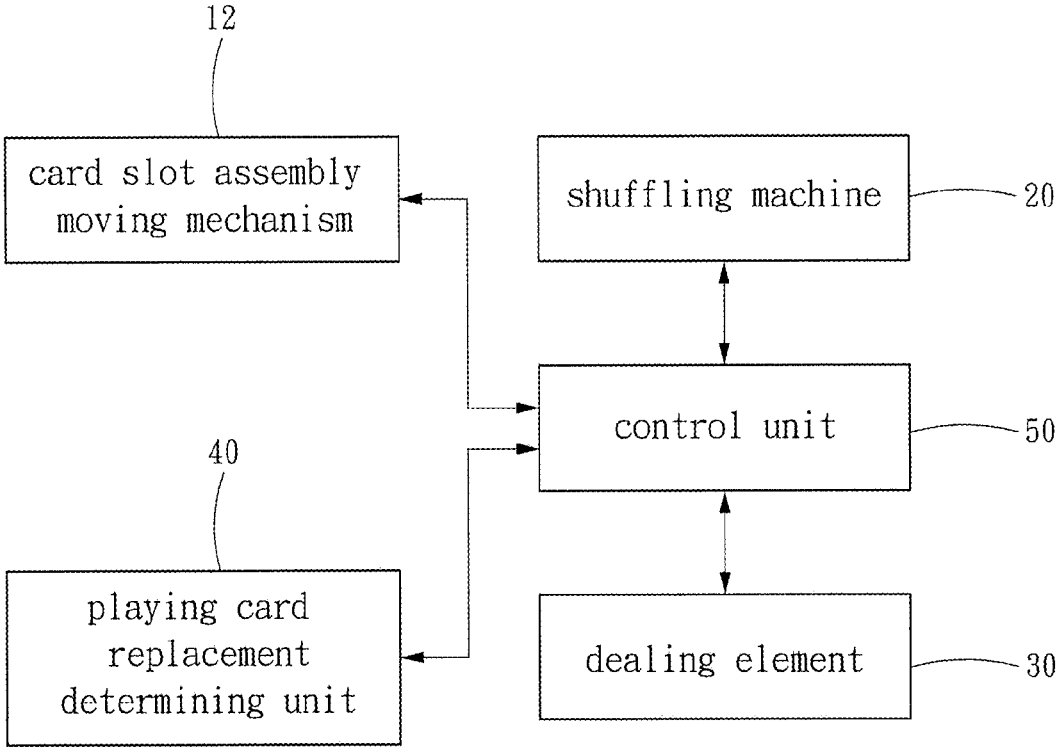
FIG. 2 is a system block diagram of the present invention.
Figure 3:
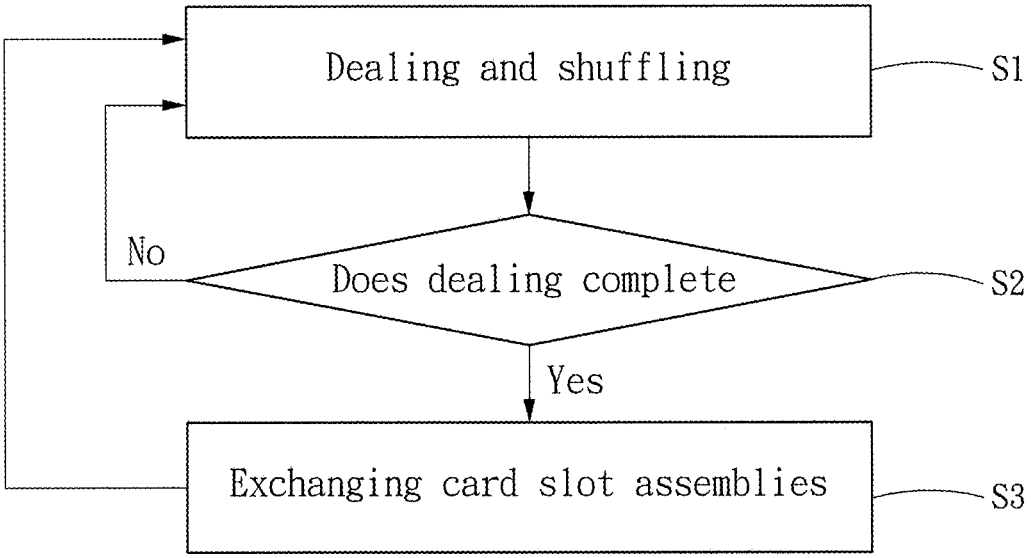
FIG. 3 is a flowchart of the present invention.

To better understand the characteristics, objects and effects of the present invention, preferred embodiments are described in detail below with reference to the accompanying drawings.

Referring to FIG. 1, FIG. 2, FIG. 3 and FIG. 4A showing an automated card shuffling and dealing device, the automated card shuffling and dealing device in turn shuffles and deals two playing card sets 100 in a game. The game may be various types of card games, e.g., baccarat, blackjack and Texas poker. The automated card shuffling and dealing device includes a dealing tabletop 10, a shuffling machine 20, a dealing element 30 that sequentially deals and uncovers cards according to a rule of the game, a playing card replacement determining element 40 that sends a replacement signal according to a predetermined rule, and a control unit 50.

The dealing tabletop 10 includes two card slot assemblies 11A and 11B capable of moving and exchanging positions, and a card slot assembly moving mechanism 12 for moving and exchanging the positions of the two card slot assemblies 11A and 11B. The two card slot assembles 11A and 11B are each disposed with a shuffled card box 13 and a dealt card box 14, and are respectively located at a card drawing position and a card shuffling position.

The shuffling machine 20 includes a to-be-shuffled slot 21 for accommodating the playing card set 100 to be shuffled, and a shuffled slot 22. The playing card set 100 to be shuffled is shuffled and then stacked in the shuffled slot 22. Further, the shuffling machine 20 moves the playing card set 100 in the dealt card box 14 to the to-be-shuffled slot 21, and moves the shuffled playing card set 100 in the shuffled slot 22 to the corresponding shuffled card box 13.

Figure 4A:
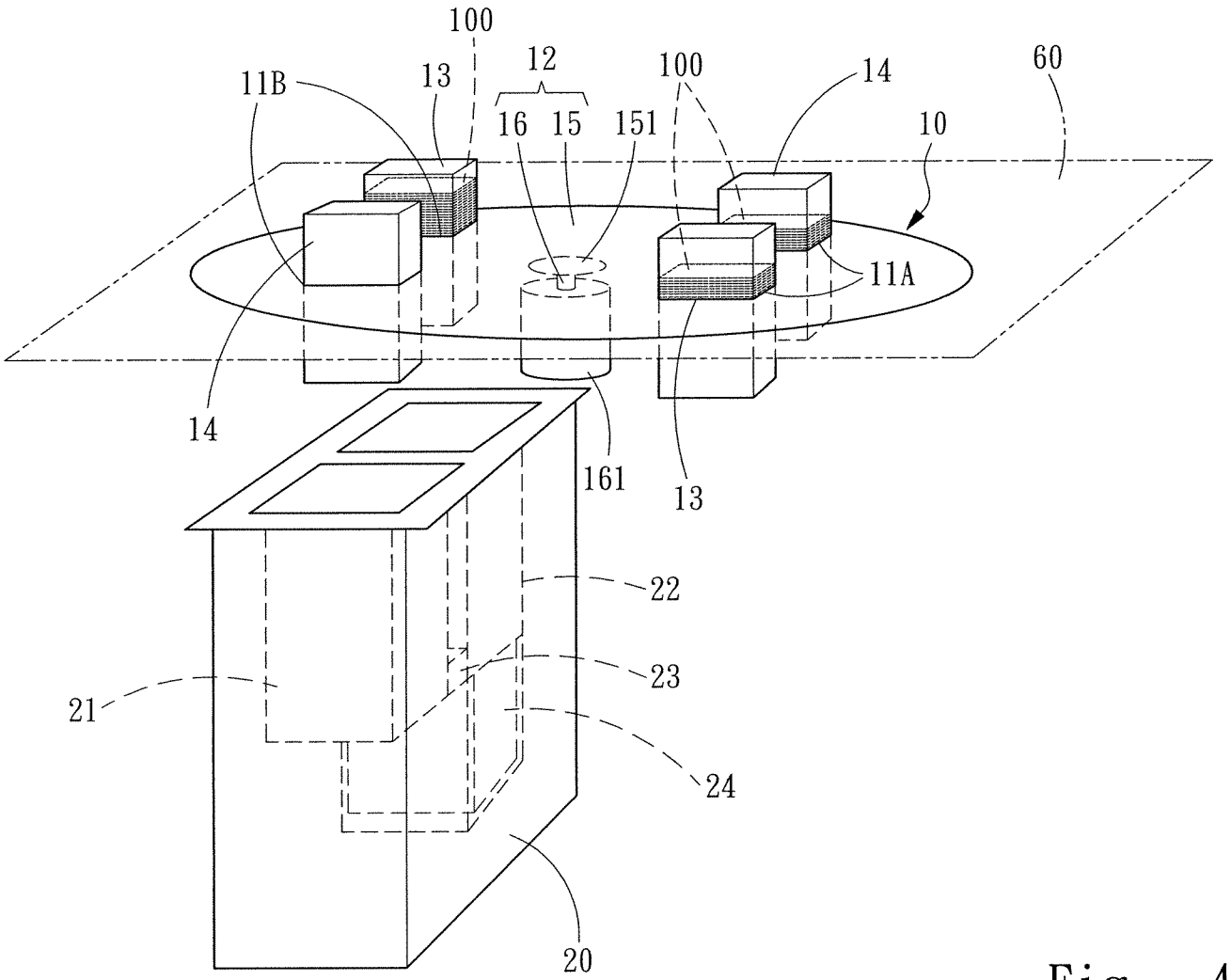
FIG. 4A to FIG. 4D are schematic diagram according to an embodiment of the present invention.
Figure 4B:
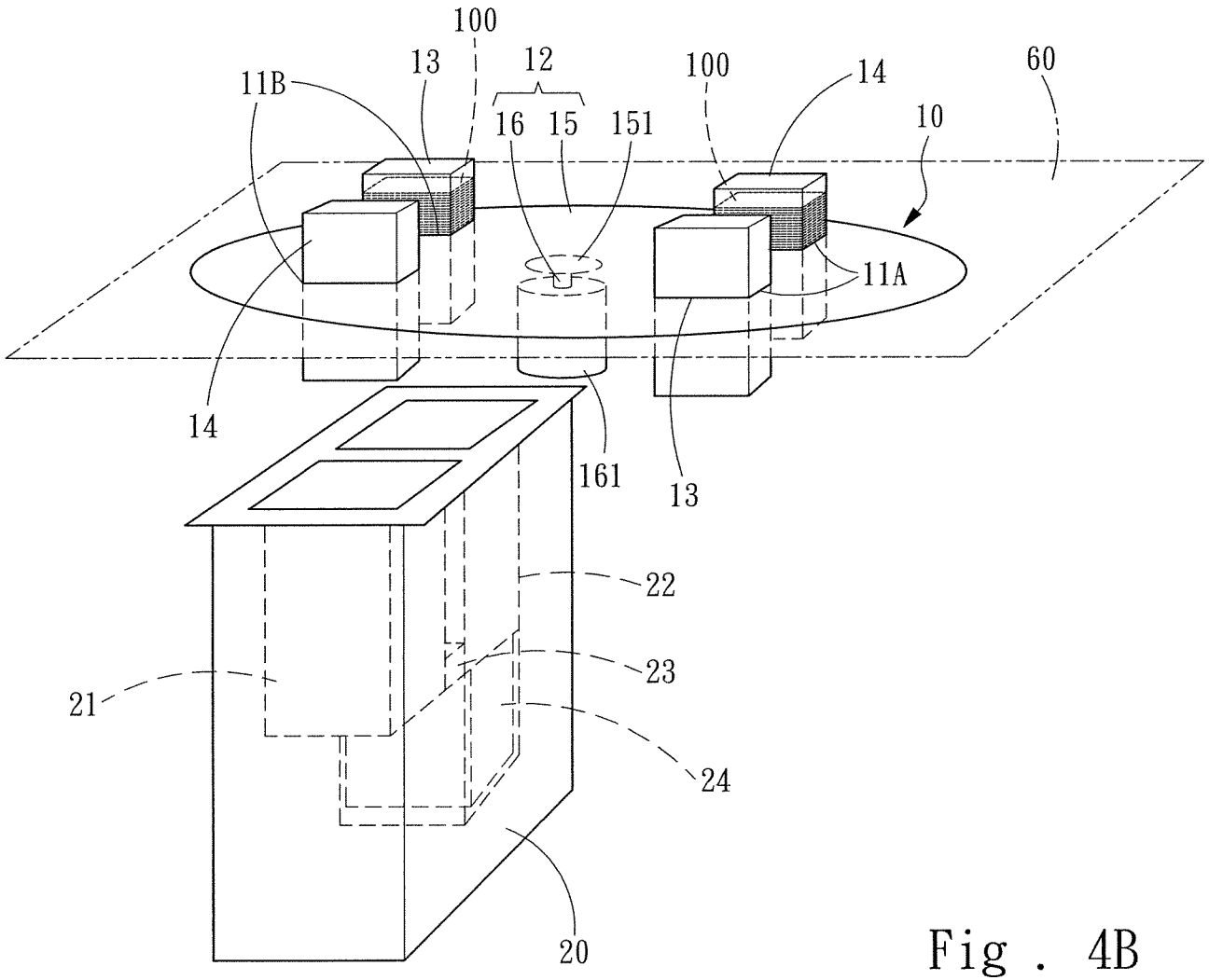
Figure 4C:
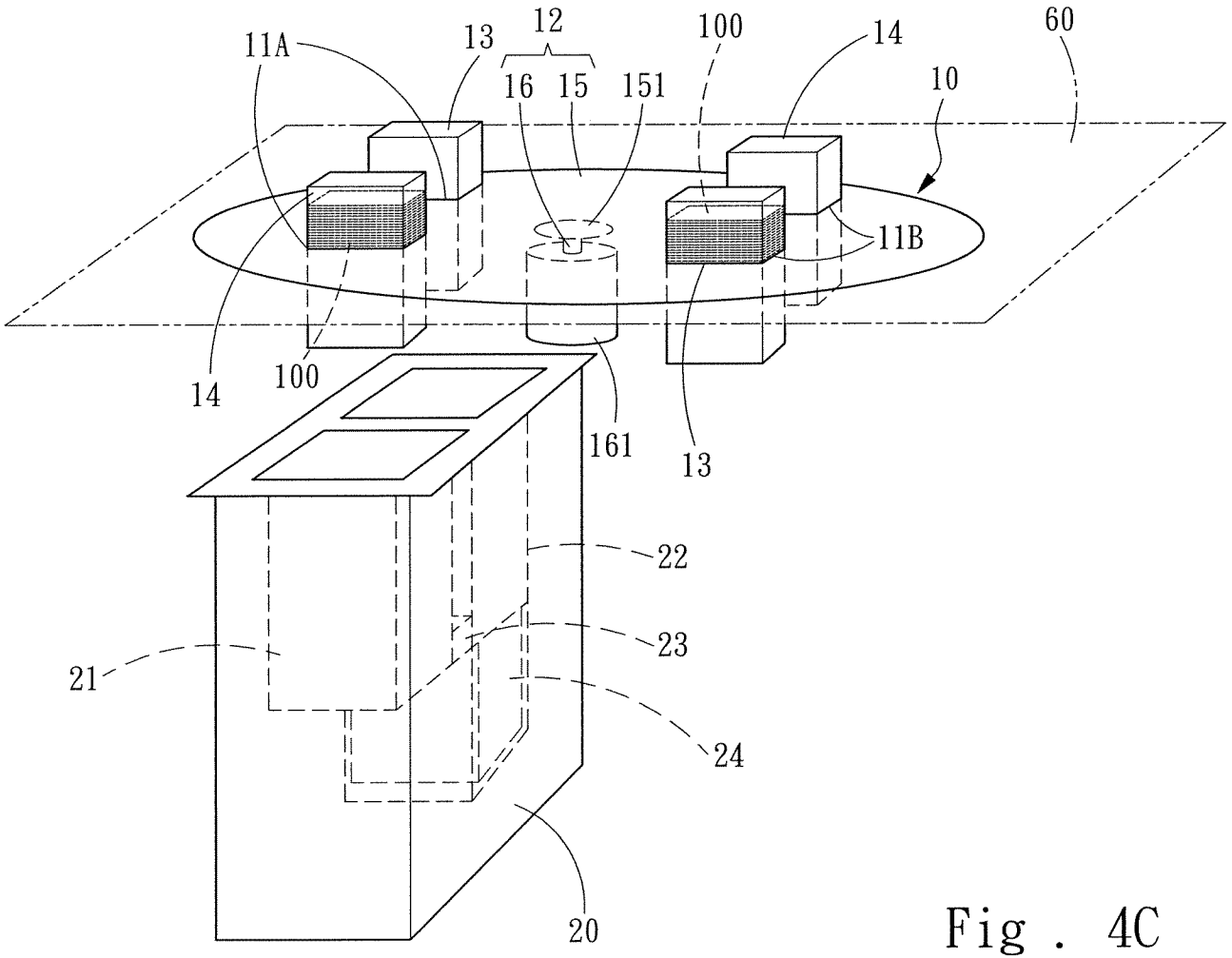
Figure 4D:
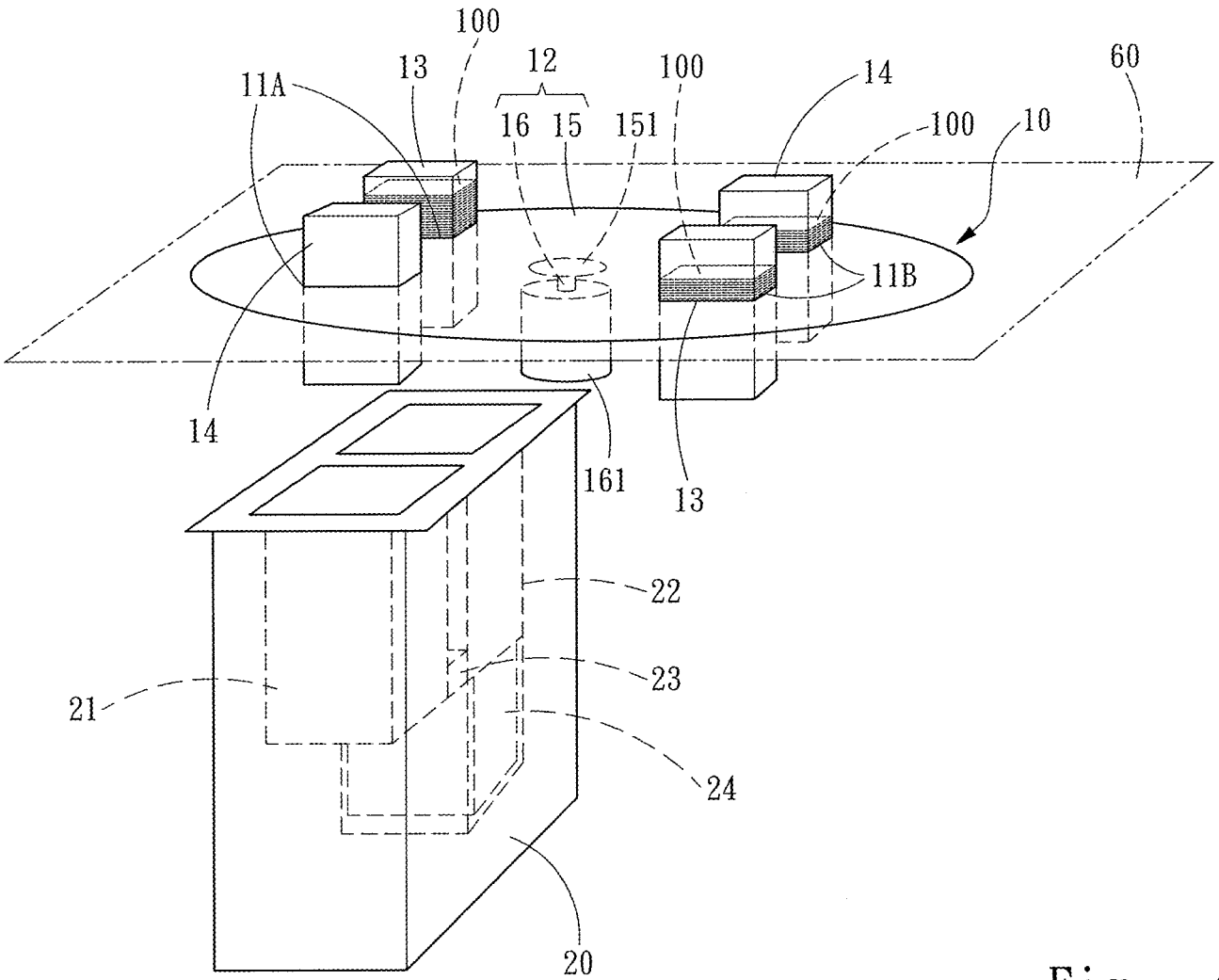

Referring to FIG. 4B, FIG. 4C and FIG. 4D, an operation process of the present invention includes following steps. In step S1, the control unit 50 controls the dealing element 30 to align with the playing card set 100 in the shuffled card box 13 of the card slot assembly 11A at the card drawing position, sequentially draw and deal the cards in the playing card set 100, and move the uncovered cards to the corresponding dealt card box 14. Meanwhile, the control unit 50 controls the shuffling machine 20 to align with and shuffle the playing card set 100 in the dealt card box 14 of the card slot assembly 11B at the card shuffling position, and stack the shuffled cards in the shuffled card box 13 (as shown in FIG. 4A).

The dealing element 30 deals cards according to a rule of the game, and so orders and patterns of card dealing are different when the rule of the game becomes different. For example, when a baccarat game is played, both parties (the dealer and the player) first get two cards, and sequentially hit cards according to the rule of the baccarat. For another example, when a blackjack game is played, the dealer and the players are sequentially given two cards, the players are then allowed to hit cards one after another, and the dealer is then allowed to hit cards. For another example, when a Texas poker game is played, cards are dealt for both parties according to the rule until there is a winner.

In step S2, during the dealing process, the playing card replacement determining element 40 continuously monitors whether the dealing process satisfies the predetermined rule. Step S1 is continued when the predetermined rule is not satisfied, or else step S3 is performed when the predetermined rule is satisfied. In step S3, the replacement signal is sent to inform the control unit 50, to cause the control unit 50 to control the dealing element 30 to stop dealing, and to move the remaining cards in the playing card set 100 into the corresponding dealt card box 14 (as shown in FIG. 4B). Next, the control unit 50 controls the card slot assembly moving mechanism 12 to exchange the positions of the two card slot assemblies 11A and 11B, so as to have the shuffled card box 13 and the dealt card box 14 of the two card slot assemblies 11A and 11B to exchange positions (as shown in FIG. 4C). After the positions are exchanged, step S1 is iterated, in which the control unit 50 again controls the shuffling machine 20 and the dealing element 30 to respectively shuffle and deal the cards (as shown in FIG. 40) to complete one cycle.

Figure 5:
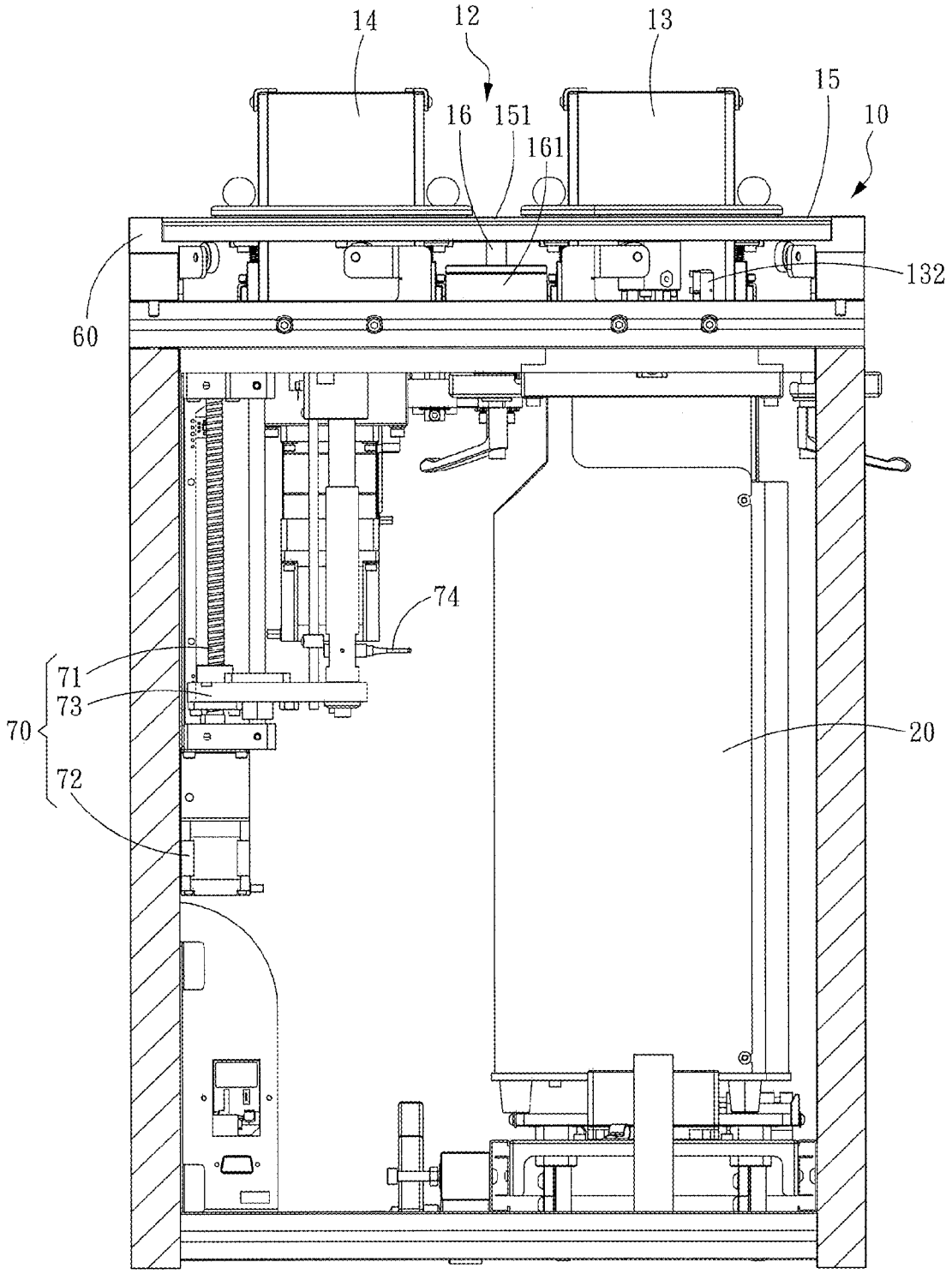
FIG. 5 is a partial section view of the present invention.

Referring to FIG. 5, the automated card shuffling and dealing device of the present invention further includes a shuffled card moving member 131 and a dealt card moving member 141, which respectively extend into the corresponding shuffled card box 13 and dealt card box 14 and support the two playing card sets 100 to move up and down. Further, each of the shuffled card moving member 131 and the dealt card moving member 141 may be connected to a height adjusting element 70. As such, the height positions of the shuffled card moving member 131 and the dealt card moving member 141 can be changed through the two height adjusting elements 70.

In practice, the two height adjusting elements 70 may each include a screw rod 71, a motor 72 driving the screw rod 71 to rotate, and an elevation portion 73 screwed and accommodated on the screw rod 71. Further, the two elevation portions 73 are respectively fixedly connected to the shuffled card moving member 131 and the dealt card moving member 141. Since the two height adjusting elements 70 drive the respective screw rods 71 to rotate through the respective motors 72 to further propel the respective elevation portions 73 to ascend and descend, the shuffled card moving member 131 and the dealt card moving member 141 are allowed to ascend and descend to change their heights.

The two height adjusting elements 70 may further each include a lower limit switch 74 for limiting a lower limit moving position of the shuffled card moving member 131 and the dealt card moving member 141. Through the detection of the two lower limit switches 74, the lower limits of the movements of the shuffled card moving member 131 and the dealt card moving member 141 are determined.

Figure 6:
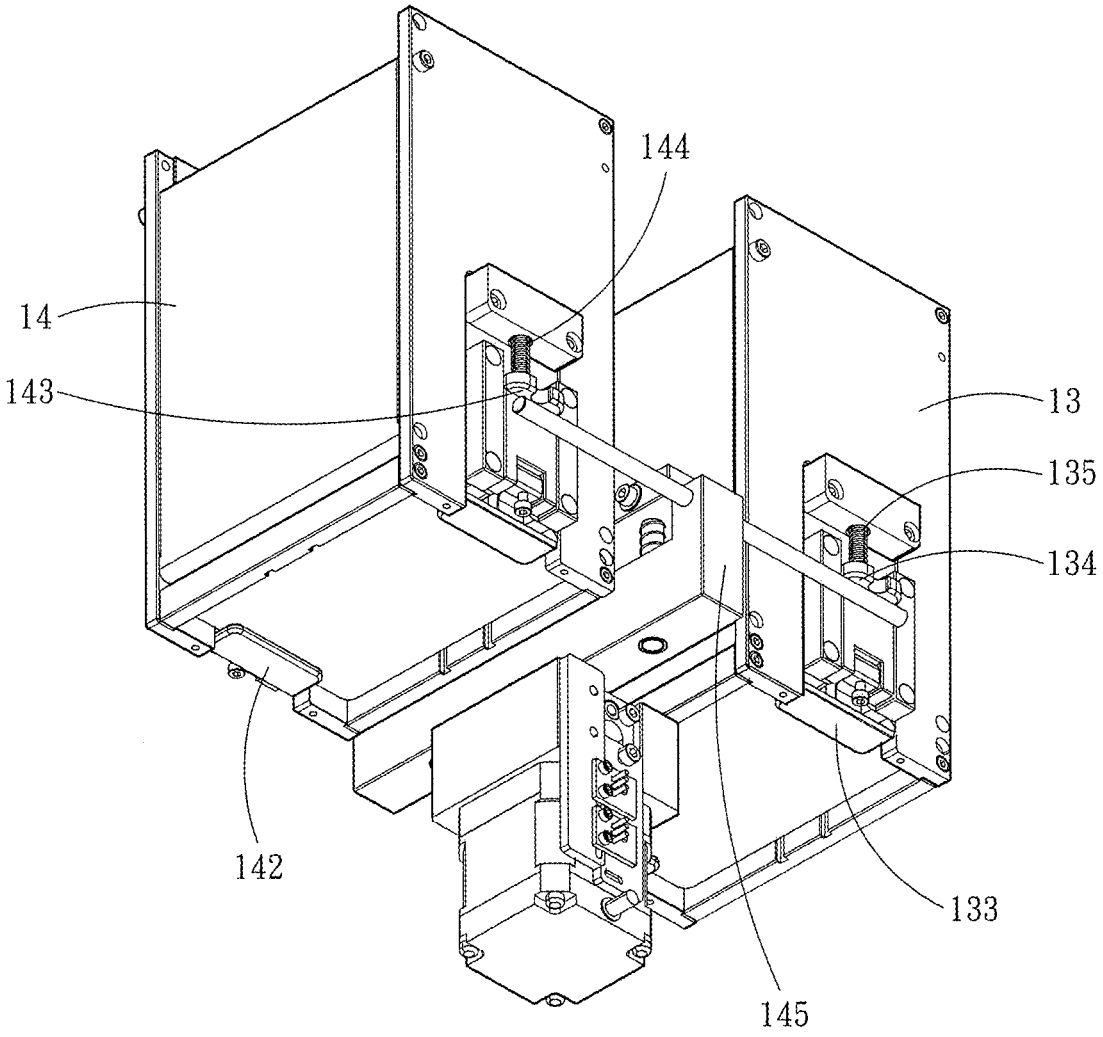
FIG. 6 is a partial component structural diagram of the present invention from another perspective.

To ensure that the at least one two playing card sets 100 are forwarded into the shuffled card box 13, the shuffled card box 13 may be disposed with a light blocking switch 132 therein. Through the detection of the light blocking switch 132, it may be ensured that the two playing card sets 100 have entered the shuffled card box 13 and are stored therein. Referring to FIG. 6, in order to forward the shuffled playing card set 100 into the shuffled card box 13 by the shuffling machine 20, and to take out the used playing card set 100 from the dealt card box 14, the shuffling machine 20 includes two bearing shaft (not shown) extendable into the shuffled card box 13 and the dealt card box 14 and a control rod (not shown) capable of ascending and descending. The corresponding shuffled card box 13 and the dealt card box 14 have hollow bottom portions, and are respectively pivotally abutted against two card blocking members 133 and 142 of the playing card sets 100. The card blocking members 133 and 142 are respectively connected to two pairs of jacking structures 134 and 143. The jacking structures 134 and 143 have an abutted state (as shown in FIG. 6) in which they drive the card blocking members 133 and 142 to rotate and are secured and abutted against the playing card set 100, and an open state in which they are not secured and abutted against the playing card set 100. Further, the jacking structures 134 and 143 are respectively pushed by restoring elements 135 and 144 on the shuffled card box 13 and the dealt card box 14 to be constantly moved downwards and be in the abutted state. When the control rod moves upwards to push a driving member 145 to move upwards and thus jacks the jacking structures 134 and 143, the card blocking members 133 and 142 are driven to be in the open state. At this point, the shuffling machine 20 is allowed to forward the shuffled playing card set 100 into the shuffled card box 13, and the used playing card set 100 may be taken out from the dealt card box 14.

In the present invention, the playing card replacement determining element 40 may be implemented by a sensing element. The sensing element detects whether the numbers of cards of the playing card sets 100 in the two shuffled card boxes 13 are lower than a predetermined number, and sends the replacement signal when the numbers are lower than the predetermined number. For example, the sensing element may be a height sensor, which estimates the number of the cards by detecting the height of the playing card sets 100. The value of the predetermined number may be determined according to different games. In other words, for a game set that uses a larger amount of cards, the predetermined number may be set to a larger value to ensure that the game is smoothly and completely conducted.

Alternatively, the playing card replacement determining element 40 may be a game set counting unit. The game set counting unit directly counts the number of sets of the game, and sends the replacement signal when the number of sets of the game reaches a predetermined number of sets.

Alternatively, the playing card replacement determining element 40 may be a dealt card number counting unit. The dealt card number counting unit counts the number of cards dealt from the playing card set 100, and sends the replacement signal when the number of cards dealt from the playing card set 100 reaches a predetermined number. Through different timings of replacing the playing card set 100 described above, not only different application requirements can be satisfied, but also an effect of preventing players from calculating and counting cards can be maximized.

The shuffling machine 20 of the present invention further includes a drawn card moving element 23 located between the to-be-shuffled slot 21 and the shuffled slot 22, and a card collecting box 24 moving up and down at the shuffled slot 22 and facing the drawn card moving element 23. After the playing card set 100 not yet shuffled is placed in the to-be-shuffled slot 21, the playing card set 100 in the to-be-shuffled slot 21 is drawn by the drawn card moving element 23, and is inserted into the card collecting box 24 as the drawn card moving element 23 randomly moves up and down at the card collecting box 24, hence completing the shuffling process.

The card slot assembly moving mechanism 12 of the present invention may include a rotating platform 15 and a rotation axis 16. The dealing tabletop 10 is disposed on the rotating platform 15. The rotating platform 15 includes a rotation center 151, and the two card slot assemblies 11A and 11B surround the rotation center 151, and rotate and symmetrically distribute around the rotation center 151. The rotation axis 16 is connected to the rotation center 151, and supports the rotating platform 15 to rotate to further allow the two card slot assemblies 11A and 11B to move and exchange positions. Further, the rotation axis 16 may be connected to a rotation motor 161 that drives the rotating platform 15 to rotate. Further, the rotating platform 15 may be rotatably mounted on a fixed tabletop 60. The to-be-shuffled slot 21 and the shuffled slot 22 are disposed below the rotating platform 15, and are respectively connected to the shuffled card box 13 and the dealt card box 14 on the two card slot assemblies 11A and 11B through the rotation of the rotating platform 15.

As described, in the present invention, through the control of the control unit, the playing card sets in the two card slot assemblies may be in turned shuffled and in turn dealt. While one of the playing card sets is being dealt using the dealing element, the other playing card set may be shuffled using the shuffling machine. After the playing card set used for dealing is completely dealt, the other playing card set may be promptly used through the method of exchanging positions to continue the dealing process, and the playing card set having been used for dealing may be shuffled at the same time using the shuffling machine, hence forming an automated card shuffling and dealing device with a cyclic application approach. Thus, the present invention provides an advantage of needing no waiting time, and cards may be continually dealt to satisfy the needs of players for uninterrupted game playing.

What is claimed is:

1. An automated card shuffling and dealing device, in turn shuffling and in turn dealing two playing card sets in a game, comprising:

a dealing tabletop, comprising two card slot assemblies for correspondingly placing the two playing card sets and capable of moving and exchanging positions, and a card slot assembly moving mechanism for moving and exchanging the positions of the two card slot assemblies, the two card slot assemblies each provided with a shuffled card box and a dealt card box, and respectively located at a card drawing position and a card shuffling position;

a shuffling machine, comprising a to-be-shuffled slot for accommodating the playing card set to be shuffled and a shuffled slot, the playing card set to be shuffled is stacked in the shuffled slot after having been shuffled, the shuffling machine moving the playing card set in the dealt card box to the to-be-shuffled slot and moving the playing card set having been shuffled in the shuffled slot to the corresponding shuffled card box;

a dealing element, sequentially dealing and uncovering cards according to a rule of the game;

a playing card replacement determining element, sending a replacement signal according to a predetermined rule; and a control unit;

wherein, the control unit controls the dealing element to align with the playing card set in the shuffled card box of the card slot assembly at the card drawing position, sequentially draw and deal the cards in the playing card set, and move the uncovered cards to the corresponding dealt card box; concurrently, the control unit controls the shuffling machine to align with and shuffle the playing card set in the dealt card box of the card slot assembly at the card shuffling position; during the dealing, the playing card replacement determining element continuously monitors whether the dealing satisfies the predetermined rule, and sends the replacement rule when the predetermined rule is satisfied to inform the control unit, to cause the control unit to control the dealing element to stop dealing, and to move the remaining playing cards in the playing card set to the corresponding dealt card box; the control unit then controls the card slot assembly moving mechanism to exchange the positions of the two card slot assemblies, so as to have the shuffled card box and the dealt card box of the two card slot assemblies to exchange positions; after the positions are exchanged, the control unit controls the shuffling machine and the dealing element to respectively shuffle and deal the cards to complete one cycle.

2. The automated card shuffling and dealing device of claim 1, wherein the playing card replacement determining element is a sensing element, which detects whether numbers of the playing cards of the playing card sets in the two shuffled card boxes are lower than a predetermined number and sends the replacement signal when the numbers are lower than the predetermined number.

3. The automated card shuffling and dealing device of claim 2, wherein the sensing element is a height sensor.

4. The automated card shuffling and dealing device of claim 1, wherein the playing card replacement determining element is a game set counting unit, which counts the number of sets of the game and sends the replacement signal when the number of sets of the game reach a predetermined number of sets.

5. The automated card shuffling and dealing device of claim 1, wherein the playing card replacement determining element is a dealt card number counting unit, which counts the number of cards dealt from the playing card set and sends the replacement signal when the number of cards dealt from the playing card set reaches a predetermined number.

6. The automated card shuffling and dealing device of claim 1, wherein the shuffling machine further comprises a drawn card moving element located between the to-be-shuffled slot and the shuffled slot, and a card collecting box moving up and down at the shuffled slot and facing the drawn card moving element; after the playing card set not yet shuffled is placed in the to-be-shuffled slot, the playing card set in the to-be-shuffled slot is drawn by the drawn card moving element and is inserted into the card collecting box as the drawn card moving element randomly moves up and down at the card collecting box, hence completing the shuffling.

7. The automated card shuffling and dealing device of claim 1, wherein the card slot assembly moving mechanism comprises a rotating platform and a rotation axis, the dealing tabletop is disposed on the rotating platform, the rotating platform comprises a rotation center, the two card slot assemblies surround the rotation center and rotate and symmetrically distribute around the rotation center, the rotation axis is connected to the rotation center, and supports the rotating platform to rotate to further allow the two card slot assemblies to move and exchange positions; the to-be-shuffled slot and the shuffled slot are disposed below the rotating platform, and are respectively connected to the shuffled card box and the dealt card box on the two card slot assemblies through the rotation of the rotating platform.

8. The automated card shuffling and dealing device of claim 7, wherein the rotation axis is connected to a rotation motor that drives the rotating platform to rotate.

9. The automated card shuffling and dealing device of claim 7, wherein the rotating platform is mounted on a fixed tabletop.

10. The automated card shuffling and dealing device of claim 7, further comprising a shuffled card moving member and a dealt card moving member, which respectively extend into the shuffled card box and the dealt card box and support the two playing card sets to move up and down.

11. The automated card shuffling and dealing device of claim 10, wherein each of the shuffled card moving member and the dealt card moving member is connected to a height adjusting element, and height positions of the shuffled card moving member and the dealt card moving member are changed through the two height adjusting elements.

12. The automated card shuffling and dealing device of claim 11, wherein each of the two height adjusting elements comprises a lower limit switch that limits a lower limit moving position of the shuffled card moving member and the dealt card moving member.

13. The automated card shuffling and dealing device of claim 11, wherein each of the height adjusting elements comprises a screw rod, a motor driving the screw rod, and an elevation portion screwed and accommodated on and the screw rod, and the two elevation portions are respectively fixedly connected to the shuffled card moving member and the dealt card moving member.

14. The automated card shuffling and dealing device of claim 1, wherein the shuffled card box is disposed with a light blocking switch therein.

* * * * *